United States Patent [19]

Hoover et al.

[11] Patent Number: 4,911,560

[45] Date of Patent: Mar. 27, 1990

[54] EASY OPEN BAG

[75] Inventors: Gregory A. Hoover, Dunedin, Fla.; E. Riley Rowe, Hartsville, S.C.; James C. Miller, Goldsboro, N.C.; H. Gordon Dancy, Hartsville, S.C.

[73] Assignee: Sonoco Products Company, Hartsville, S.C.

[21] Appl. No.: 321,824

[22] Filed: Mar. 7, 1989

Related U.S. Application Data

[63] Continuation-in-part of Ser. No. 179,461, Apr. 8, 1988, abandoned.

[51] Int. Cl.[4] ..... B65D 33/10

[52] U.S. Cl. ..... 383/8; 383/10; 383/35; 383/120

[58] Field of Search ..... 383/8, 10, 35, 120

[56] References Cited

U.S. PATENT DOCUMENTS

| | | | |
|---|---|---|---|
| 1,015,007 | 1/1912 | Cutler . | |
| 1,948,569 | 2/1934 | Falk . | |
| 1,951,011 | 3/1934 | Falk . | |
| 2,189,174 | 2/1940 | Hohl . | |
| 2,628,764 | 2/1953 | Rubinstein et al. | 383/120 |
| 3,023,947 | 3/1962 | McDuffie | 383/120 |
| 3,297,232 | 1/1967 | Fesco . | |
| 3,421,683 | 1/1969 | Fesco . | |
| 3,457,707 | 7/1969 | Fesco . | |
| 3,670,954 | 6/1972 | Leventhal . | |
| 4,096,987 | 6/1978 | Rodish . | |
| 4,554,192 | 11/1985 | Benoit . | |
| 4,696,403 | 9/1987 | Hoover . | |
| 4,720,872 | 1/1988 | Kaczerwaski . | |

FOREIGN PATENT DOCUMENTS

| | | | |
|---|---|---|---|
| 1803481 | 5/1970 | Fed. Rep. of Germany . | |
| 0115153 | 10/1945 | Sweden | 383/35 |
| 130910 | 3/1929 | Switzerland . | |
| 405057 | 7/1966 | Switzerland . | |

*Primary Examiner*—Stephen Marcus
*Assistant Examiner*—K. M. Stemann
*Attorney, Agent, or Firm*—Dennison, Meserole, Pollack & Scheiner

[57] ABSTRACT

A plastic film bag with overlying front and rear bag walls, the upper edges of which define a bag mouth. Pleats defined in each bag wall extend vertically downward from the mouth-forming edges. The pleats, upon expansion by direct finger engagement therewith or the application of outwardly directed opposite forces on the opposed ends of the mouth portion of the bag, cause a lateral separation of the edges for initiating opening of the bag mouth. The bag may be vertically partitioned into lateral compartments with at least one wall of each compartment including a mouth-opening pleat therein.

21 Claims, 4 Drawing Sheets

EASY OPEN BAG

This is a continuation-in-part of Hoover, et al U.S. application Ser. No. 179,461, filed Apr. 8, 1988, for "Plastic Bag with Easy Opening Mouth" now abandoned.

BACKGROUND OF THE INVENTION

Plastic bags, that is bags formed of thermoplastic synthetic resin film, for example polyethylene, have come into common usage as produce bags, grocery bags, general and specialty merchandise bags, and the like. Such bags are produced in a variety of configurations and constructions with one of the most widely known forms of bag being what is usually referred to as a T-shirt bag. The T-shirt bag is normally formed with a pair of side gussets and includes a pair of laterally spaced upwardly extending handles with a transverse bag mouth therebetween. Other conventional forms of handle bags include bags with central extending handles and bags with handles defined by cutouts through the front and rear walls of the bag. The bags may be partitioned into multiple chambers as in U.S. Pat. No. 4,696,403, issued Sept. 29, 1987, and commonly assigned with this application, or may comprise flat ungusseted bags with no handles as frequently found at produce stands.

While plastic bags have significant advantages over conventional paper bags for supporting produce, groceries and the like, and thus have found wide acceptance in the marketplace, one particularly vexing problem with regard to the use of such bags is the difficulty in opening the bag mouth. This difficulty is a direct result of several factors arising from the nature of the material itself and the manner in which the bag is formed. For example, "static cling" is invariably present between the extremely thin film sheets of the individual bags. Further, there is a tendency for the film sheets to stick as a result of additives and other chemicals migrating to the surface of the plastic film. Adhesion between the bag sheets also frequently arises as a result of the actual cutting operation which defines the bag mouth, producing, for example, a weak cold welding of the sheet edges together.

In each case, while the sheets at the bag mouth are separable, there are inherent difficulties in obtaining an initial sufficient grip on the sheets to overcome the natural tendency of the mouth of the bag to remain closed and to effect the desired opening of the bag mouth. This is the situation regardless of whether the bag is severed from a pack or roll, or provided as a separated bag.

SUMMARY OF THE INVENTION

The present invention is specifically concerned with plastic bags, that is bags formed of thermoplastic resin film, which incorporate means, as an integral part of the individual bags, for facilitating the opening of the mouths of the bags.

More specifically, the invention proposes formation of plastic film bags with expanding pleats formed in either or both of the opposed front and rear walls of the bags with the positioning of the pleats in the individual bags being defined by the nature of the bags. The invention also proposes and allows for a plurality of procedures whereby the pleats are utilized to open the bag mouth. Such procedures vary from a direct manipulation of the pleats, to a manipulation of the bag edges remote from the pleats, for example, in conjunction with another action such as removal of the bag from a pack, or the positioning of the bag on a support rack. This latter procedure is particularly convenient in T-shirt bags wherein the bag handles are normally outwardly drawn as the bag is removed from a pack and/or engaged over support rack arms. As will be detailed subsequently, the outward drawing of the bag handles will in turn produce a lateral unfolding of the pleats and a corresponding separation of the mouth edges of the bag for easy access to the bag mouth.

Basically, in order to facilitate opening of a bag mouth, either or both the front and rear sheets or walls of the bag are provided with a full height pleat extending vertically between the bag mouth, defined by the free upper edge of the walls, and the bottom of the bag, defined by the lower edges joined by a transverse heat-sealed seam. The pleat, in each sheet, defines opposed sheet sections with an integral intermediate panel therebetween overlying respective equal width panel-defining portions of the two sheet sections. So formed, the pleats enable use of a variety of procedures to effect an opening of the bag mouth. For example, an outward pulling of the bag handles in T-shirt bags, or upper opposed bag corners of flat-top bags, will produce a sliding of the pleat panels relative to each other with the intermediate panel rolling or turning between the corresponding two sheet panels to overcome any inherent tendency for the sheets to remain together because of static electricity or cling, chemical bonding, cold welding, or the like, and will effect a separation of these panels and a lateral movement of the corresponding bag sheet, or at least a portion thereof at the mouth, away from the second bag sheet. The formation of the second bag sheet with a similar pleat and slidably cooperating panels, enhances the separation of the sheets at the bag mouth, providing for a positive freeing of the edges defining the bag mouth and an initial separation of the sheets and opening of the bag mouth for unencumbered access thereto.

As will be appreciated, a further manual opening of the bag will be required for a loading of goods therein. However, the heretofore described difficulties of initially separating the sheets, because of static cling, cold welding, or the like, is eliminated. In doing so, the bag incorporates no additional material as compared to the conventional bag and requires no special procedures or handling other than for exerting a slight outward pull on the upper corners of the bag to the opposite sides of the bag mouth, a procedure which is commonly effected in the normal mounting of T-shirt bags on loading racks and the like.

The wall pleats, because of the increased thickness and the free vertical edge defined thereby, can also be directly grasped between the fingers and forwardly drawn to separate the bag walls, initially at the mouth and subsequently for the height of the bag. This procedure can be effected simultaneously with withdrawal of a bag from a stack or roll of bags for both dispensing and opening of the bag. Individual bags can be conveniently opened by a direct grasping of the opposed pleats of the two bag walls.

Another procedure for utilizing a pleat or pleats to facilitate access to a bag mouth is to position the fingers of one hand to the opposite sides of the bag mouth at the pleat and slide the fingers relative to each other. This will cause a relative sliding and unfolding of the pleat panels and sufficient separation of the mouth edges to allow for an easy grasping of these edges and a direct opening of the bag mouth.

The wall pleats, in a handle bag or flat top bag will normally be centrally located, extending vertically downward from the bag mouth to the sealed lower edge of the bag. This central location is desirable in that an initial central spreading of the bag mouth facilitates a manual grasping of the upper bag edges and a complete opening of the bag.

The use of pleated walls in plastic film bags is particularly desirable in multiple compartment or partitioned bags, for example of the type shown in commonly assigned U.S. Pat. No. 4,696,403, wherein the bags are divided into separate laterally adjacent chambers which may be separated into individual carriers. The chambers, normally defined from a standard width bag, include narrow mouths which must be individually opened. This becomes increasingly more difficult as the width of the mouth narrows. The present invention proposes the provision of a pleat in one or both of the opposed walls of each of the chambers. Thus, the chambers can, depending on the procedure used to open the pleats, either be simultaneously or individually opened.

In the actual formation of the bags, normally from a continuous tubular film, the only additional step involved is the provision of one or more longitudinal pleats along the opposed front and rear bag sheets or walls. The pleats will be formed prior to a heat seaming and forming of the upper and lower edges of the bag and prior to forming the bag mouth.

Formation of the bags in the above manner results in a reduction in the width of the bags, thus providing particular secondary advantages in that less space and smaller containers can be used in the storage and shipping of the bags. In addition, if the bags are to be provided on a roll, further savings are available by the use of both shorter cores and smaller packaging boxes. Inasmuch as bags of the general type involved herein are produced in the millions, savings on any aspect of the manufacture, shipping and using of such bags will involve substantial sums of money, a significant factor in any product.

The pleats in the bag sheets or walls have the individual panels thereof secured only along the bottom seam of the bag. As such, while the overall width of the bag as shipped is reduced, upon an opening of the bag, the pleats expand fully for the entire height of the bag other than for the portion thereof immediately adjacent the lower seam. Thus, in use the full effective width of the bag is retained, notwithstanding the wall pleats. Further, in light of the retention of the pleats at the secured lower ends thereof in the open bag, the pleats immediately outward of the lower seam encourage the definition of a flat bottom which in turn facilitates stacking of goods within the bag.

Additional objects and advantages may be noted as residing in the details of the invention as more fully hereinafter described and claimed.

DESCRIPTION OF THE PREFERRED EMBODIMENTS

Figure 1:
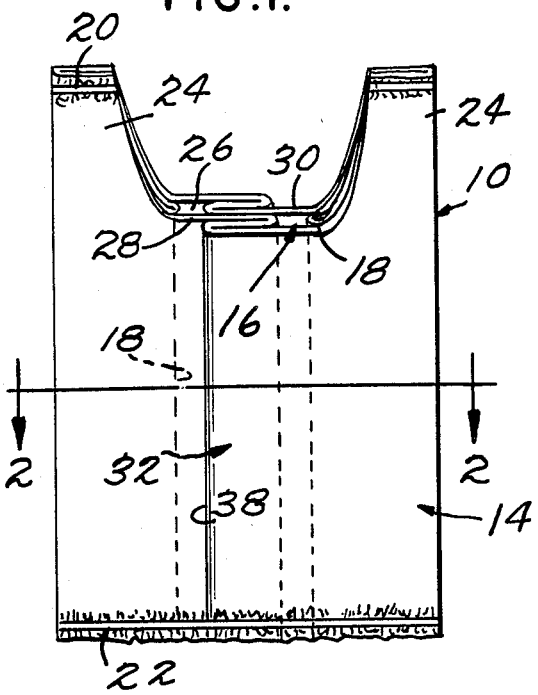
FIG. 1 is a perspective view of a plastic T-shirt bag formed with a pair of mouth-opening expanding pleats in the opposed walls thereof.
Figure 5:
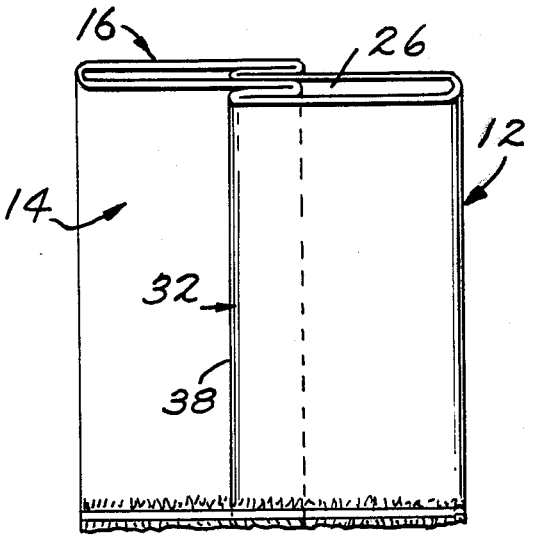
FIG. 5 is a perspective view of a flat top bag, or bag without projecting handles, including the mouth-opening pleats.
Figure 2:
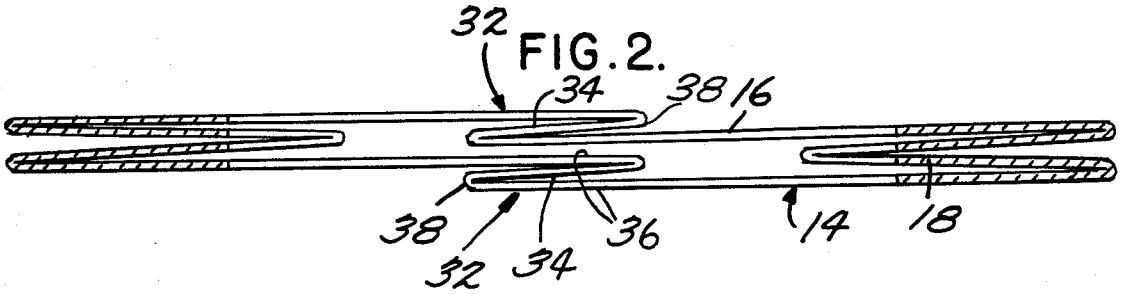
FIG. 2 is enlarged transverse sectional view of the bag, taken substantially on a plane passing along line 2—2 in FIG. 1, illustrating the pleats defined in the front and rear bag walls or sheets.

Referring now more specifically to the drawings, FIG. 1 illustrates a basic handle or T-shirt bag 10. FIG. 5 illustrates a basic flat top bag 12 without projecting handles. The bags 10 and 12, as illustrated, will normally be defined from a tubular length of synthetic resin film flattened to form front and rear bag walls or sheets 14 and 16 integrally joined along opposed edges thereof either directly as in the bag 12 or by inwardly formed side gussets 18 as in bag 10. While any of the bags might be formed without side gussets, such gussets have been found to be a particularly desirable feature in providing maximum bag width and interior capacity. The gussets 18 in T-shirt bags also provide for enhanced strength in the bag handles.

The upper and lower transverse edges 20 and 22 of the T-shirt bag 10 are closed by a heat-sealing or the like of the front and rear bag walls 14 and 16 with the upper and lower ends of the side gussets sandwiched therebetween. The opposed bag handles 24 and the bag mouth 26 transversely between the inner ends of the handles are defined by a basically U-shaped cutout inwardly through the upper end of the bag. As desired, the joinder areas between the opposed ends of the bag mouth 26 and the handles 24 can be configured for stress relief.

In the flat top bag of FIG. 5, the entire length of the upper edges of the front and rear bag walls 14 and 16 define the mouth 26 of the bag. The lower edges of the front and rear bag walls are closed in a conventional manner by heat-sealing or the like.

The bags as thus far described are known and are commercially used on a wide scale. However, and as previously discussed, a significant problem with regard to such bags is the difficulty in opening the bag mouth for access to the interior thereof. This difficulty arises from several factors including static cling and the tendency for the bag mouth edges to adhere to each other as a result of the cutting operation. Incidentally, at this point, it should be recognized that the thickness of the bag walls as shown in the Figures has been substantially exaggerated for purposes of illustration. The actual thickness of the film is less than a single drawn line.

The present invention is specifically directed to means for facilitating an initial opening of the bag mouth 26 through separation of the top edges 28 and 30 respectively of the front and rear bag walls or sheets 14 and 16 which define the mouth 26. The means for facilitating the opening of the bag consists basically of integrally joined overlying panels vertically oriented in one or both bag walls 14 and 16 for a transverse sliding movement relative to each other and a resultant lateral separation of the bag walls at the mouth.

Figure 4:
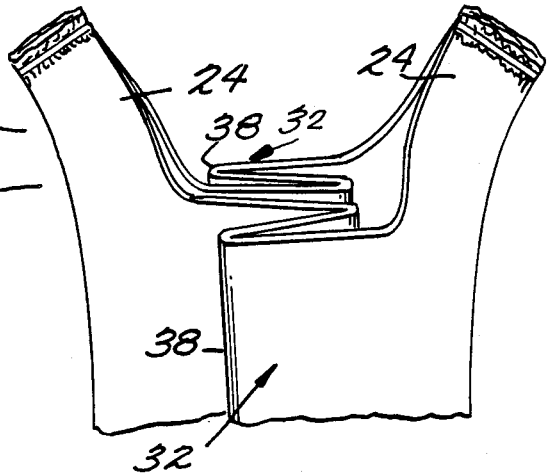
FIG. 4 is a view similar to FIG. 3 illustrating a variation in the pleating.

More specifically, each bag wall or sheet 14 and 16, has a vertically elongate pleat 32 defined therein. Each pleat 32 commences at the top mouth edge 28 or 30 and extends vertically downward, preferably throughout the full vertical height of the bag for a variety of reasons including manufacturing convenience. Each pleat 32 includes an intermediate panel 34 integral with and between equal width portions 36 of the associated sheet or wall 14 and 16. The portions 36 define panels of the pleat which are also planar portions of the two sections of each sheet to each side of the central pleat. The lower ends of the pleats 32 of the two bag walls 14 and 16 are sealed to and within the lower or bottom transverse seam, with the panels otherwise being free to separate or expand. The formed pleats 32 in the two bag walls 14 and 16, can be either oppositely directed as in FIGS. 1 and 5 or commonly directed as in FIG. 4, that is with the exterior folds 38 of the pleats to the opposite sides of a common vertical center line or to the same side thereof. As will be noted, the pleats have the inner folds thereof positioned inward of the inner folds of the side gussets. Further, the actual widths of the pleats, while illustrated as being only slightly less than the transverse distance between the gussets, can be narrower as long as sufficient sliding action is retained to effect the desired bag wall separation.

Figure 15:
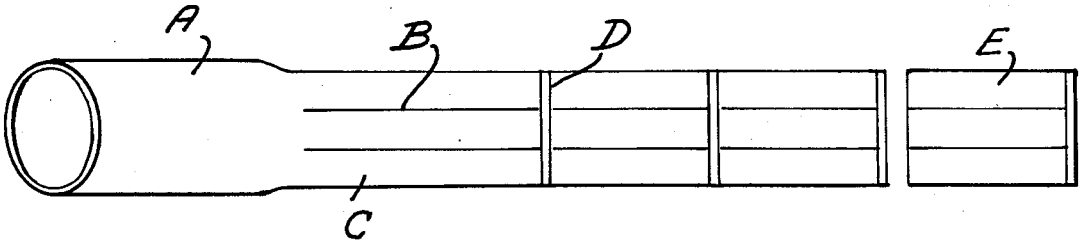
FIG. 15 schematically illustrates a method of forming pleated bags in accord with the present invention.

FIG. 15 schematically illustrates formation of a basic bag in accord with the present invention. The involved method includes providing a continuous tube A of a plastic film material. At least one continuous longitudinal pleat B is formed in the tube, with the at least one pleat comprising a folded portion of the tube defining overlying inner and outer panels and an intermediate panel joining said inner and outer panels, the panels being otherwise substantially free of interconnection.

The pleated tube is collapsed to define flat overlying front and rear walls C with joined side edges, and with said at least one longitudinal pleat being disposed in one or both of said front and rear walls and lying substantially in the plane of such wall.

A transverse seal D is formed between the front and rear walls at longitudinally spaced apart locations along the length of the tube, and the front and rear walls are substantially severed at the longitudinally spaced apart locations to form a series of individual bags E with each a transverse seal forming a closed bottom for each bag.

Figure 3:
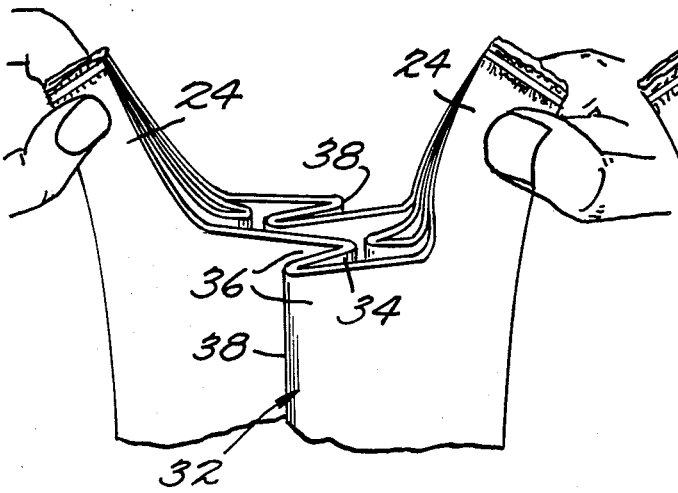
FIG. 3 is a perspective view of the upper portion of the bag of FIG. 1 with the mouth opened through an outward drawing of the opposed handles.

With regard to the basic T-shirt bag of FIG. 1, the automatic opening of the bag mouth 26 is achieved, as suggested in FIG. 3, by grasping and outwardly moving the handles 24 in the normal manner associated with the mounting of the bag on a loading rack. The lateral outward pulling or movement of the handles 24 results in a sliding of the pleat panels relative to each other and an inverting or reversing of the intermediate panels 34 in a manner which tends to separate the outermost panels of the pleat and, more significantly, separate the bag walls 14 and 16 from each other. This separating movement of the pleat panels overcomes any static cling or other adherence between the bag walls, particularly at the mouth 26, with the separation being sufficient to space the top edges of the bag walls for manual access thereto for a full opening of the bag.

Figure 11:
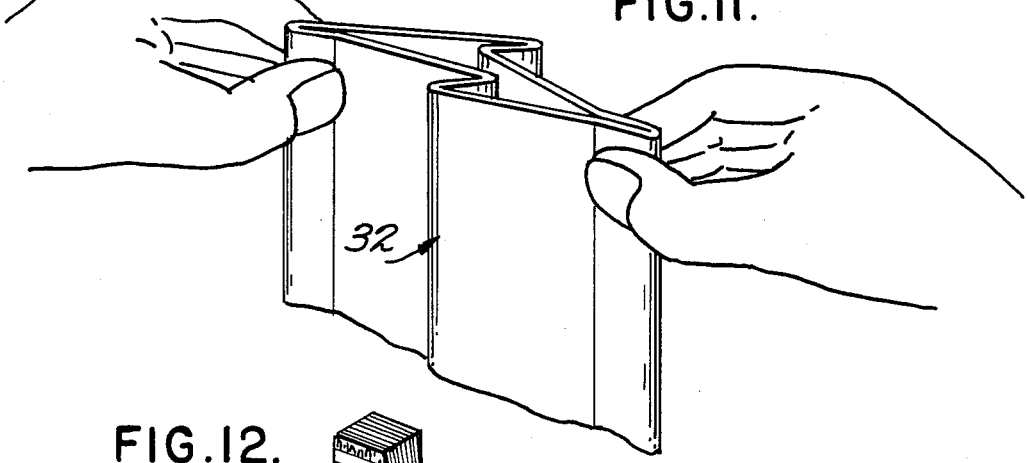
FIG. 11 illustrates a similar method applied to flat top bags.

As will be appreciated from FIG. 11, the opening of flat top pleated bag 12 can be effected in substantially the same manner as the T-shirt bag 10 by grasping the upper portions of the bag walls outward of the central vertical pleats 32 and outwardly pulling thereon to effect an expansion of the pleats 32 in either or both walls. In the absence of such pleats 32, lateral movement of the handles or upper corner portions of bags 10 and 12 merely results in a longitudinal stretching of the mouth edges without any tendency to separate or facilitate access thereto. With the mouth-opening pleats, a sufficient force is developed transversely of the mouth edges to effect a lateral separating of these edges.

A full expansion of the bags 10 or 12, as by the introduction of goods thereto, will be achieved by a complete expansion of the pleats 32, as well as the side gussets 18 if provided, throughout substantially the full height of the bag other than at the bottom thereof. At the bottom of the bag, the side gussets tend to fold to a triangular configuration encouraging the formation of a flat bottom. The center pleats 32 are retained folded immediately adjacent the bottom seam 22 and similarly tend to enhance the definition of a generally flat bottom in the expanded bag, a particularly desirable feature for the accommodation of goods.

Figure 6:
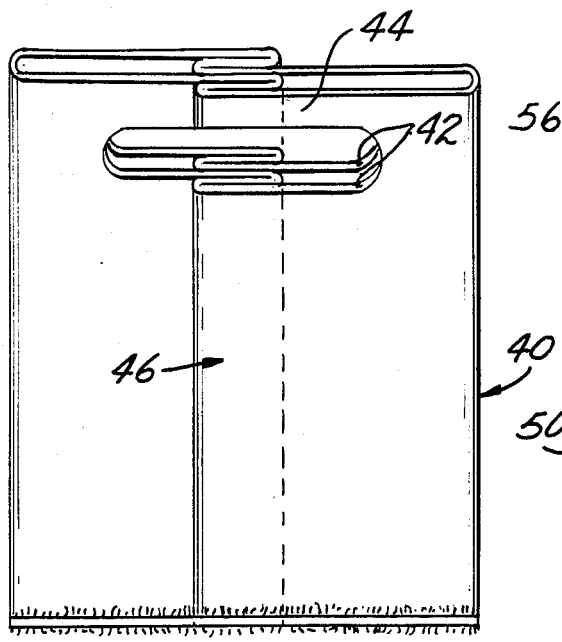
FIG. 6 is a perspective view of a modified form of flat top bag with hand holes formed through the front and rear bag walls.

FIG. 6 illustrates a modified form of flat top bag 40 wherein hand holes 42 are cut through the front and rear bag walls in downwardly spaced relation to the upper free mouth-defining edges thereof. That portion 44 of the bag walls between the hand holes 42 and the upper edges defines a handle. In the bag 40, the mouth-opening vertical pleat or pleats 46, formed in the manner of the pleats 32, will extend vertically for the full height of the bag 40 between the sealed lower edges thereof and the free upper edges. The provision of the pleats 46 in such a bag will be particularly desirable in that the formation of the hand holes 42 will inherently tend to further increase the adherence of the overlying sheets to each other in the mouth area, thus making normal opening of the bag more difficult. Initiation of the opening of the bag 40 can be effected by the procedure illustrated in FIG. 11.

Figure 7:
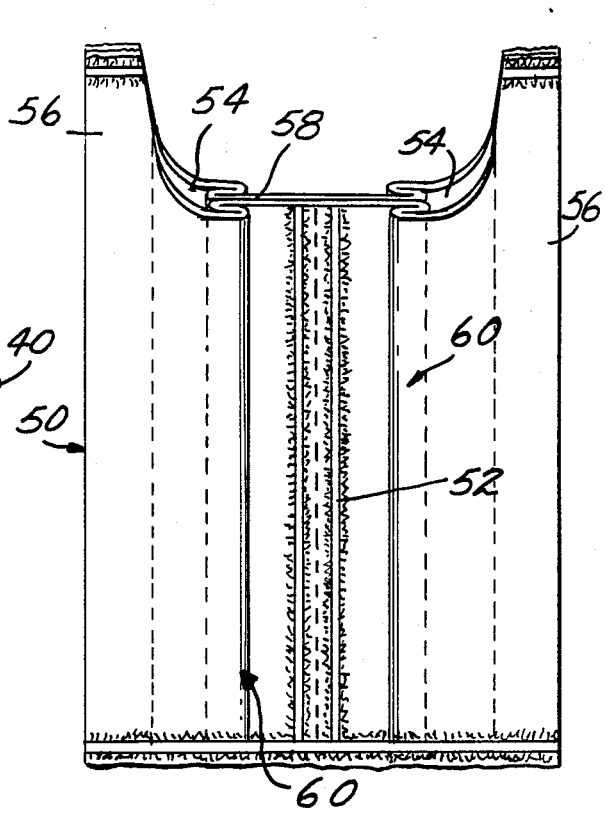
FIG. 7 is a perspective view of a bag with a central vertical severance line to define separable compartments, each compartment having separate mouth-opening pleats.

Referring now specifically to FIG. 7, the bag 50 illustrated therein is basically a dual compartment T-shirt bag with a central vertical joinder line 52 which both defines the two compartments or chambers 54, one aligned with each of the handles 56, and provides for a severing of the bag into two separate carriers, all as detailed in U.S. Pat. No. 4,696,403.

In view of the limited width of the compartments 54, and the overlying relation of the associated handle 56 to each compartment mouth 58, the opening of the compartment mouths 58, either in a unitary bag or when severed into separate carriers, is particularly difficult. Accordingly, a significant object of the present invention is to provide a system for facilitating the opening of these mouths of the individual compartments of the bag 50.

Figure 10:
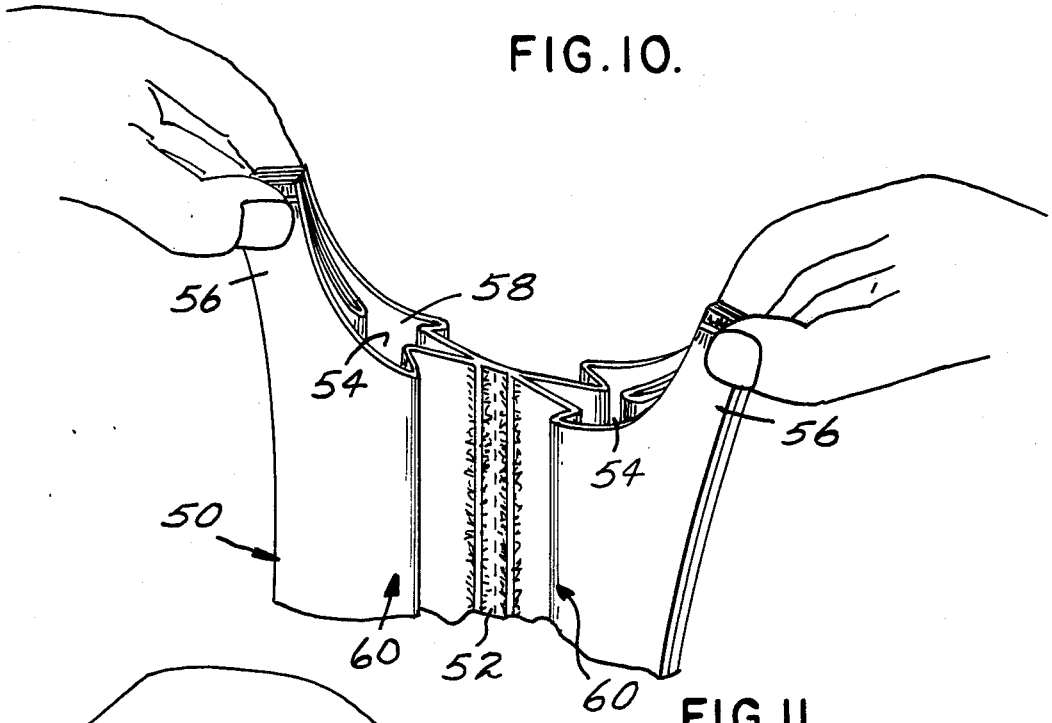
FIG. 10 illustrates a method of opening the compartmented bag of FIG. 7.

The bag 50 includes front and rear bag walls which, respectively, define two front and two rear compartment walls. Each of the bag walls includes a pair of vertically extending full height mouth-opening pleats 60, one centrally of each of the two compartments and extending downward from the open mouths of the compartments. Each of these pleats generally duplicates the pleats 32 and 46, and includes an intermediate panel defined between equal width portions of the associated compartment wall. Formed in this manner, the dual compartments can be simultaneously opened by a grasping and outward movement of the opposed handles 56 as suggested in FIG. 10. Alternatively, and in particular if the bag 50 is severed into separate carriers, the utilization of the pleat to initiate bag opening can be effected by a direct grasping of the bulkier pleat between the fingers as suggested in FIG. 13 for an initial lateral separation of the upper edges of the compartment walls. As illustrated, it is preferred that the pleats on the opposed walls be simultaneously grasped and drawn apart.

As an alternate procedure, the front and rear compartment walls, at the pleats, can be slid longitudinally relative to each other through manipulation of a pair of opposed fingers. This in turn will cause a sufficient rolling and outward separation of the pleat panels of the walls at the compartment mouth to allow for direct finger insertion for a full opening of the bag. Such a procedure is illustrated in FIG. 14 in conjunction with a single chamber bag of the type shown in FIG. 5.

Figure 13:
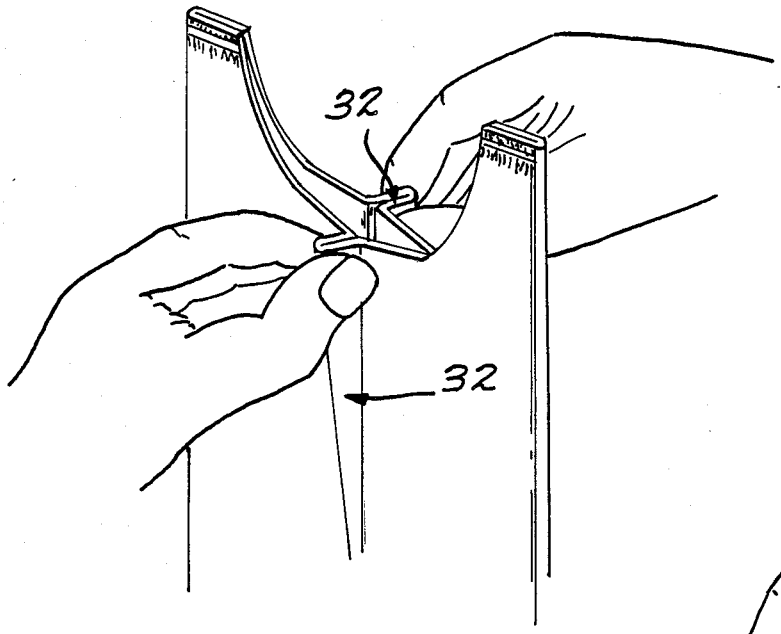
FIG. 13 illustrates a method of opening a bag or bag compartment through direct finger engagement with opposed pleats.
Figure 14:
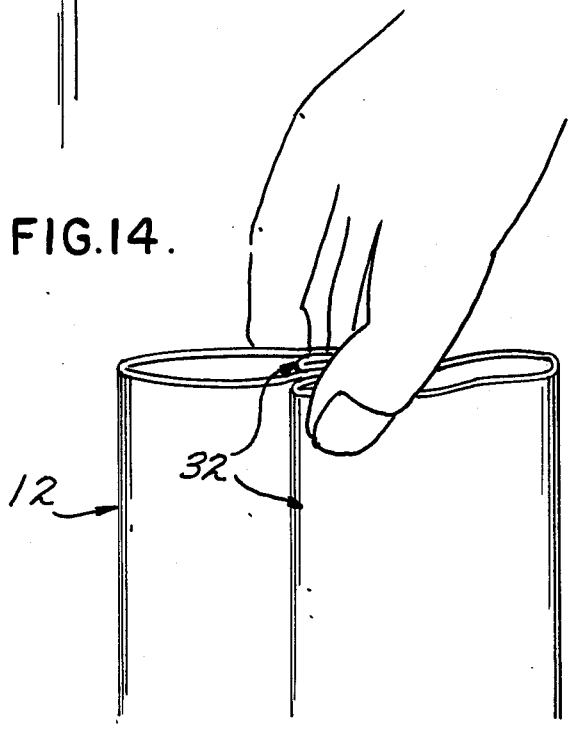
FIG. 14 illustrates a method of opening a bag wherein the front and rear bag walls, at the pleat or pleats, are slid parallel to each other to produce a mouth-opening movement of the pleats.

It will be appreciated that the procedures of FIGS. 13 and 14 for the opening of film bags are equally adapted to any of the disclosed bags, including T-shirt and flat top bags, whether of single or multiple compartments.

Figure 12:
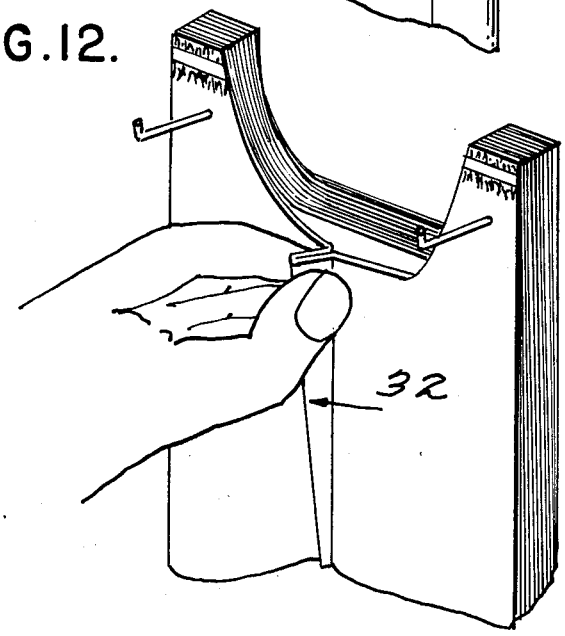
FIG. 12 illustrates a method of dispensing and opening bags from a rack-mounted pack of bags through a direct grasping of the pleat in the leading bag wall.

As previously noted, the pleated bag, regardless of the specific type of bag, can be formed with a pleat in only one of the two walls thereof as suggested by the T-shirt bag in FIG. 12. Such a bag is particularly adapted for mounting in a pack on rack arms which support the leading bag for loading. The provision of the pleat in the leading bag wall allows the user to grasp the pleat adjacent the bag mouth, with a forward pull on the pleat causing an expansion of the pleat, a separation of the edges of the bag mouth, and a forward opening of the bag for loading. Similarly, while the compartment bag of FIGS. 7 and 10 has been described as incorporating vertical pleats in both compartment walls, it is conceivable that each compartment will include only a single pleated wall with the second wall thereof being unpleated.

Figure 8:
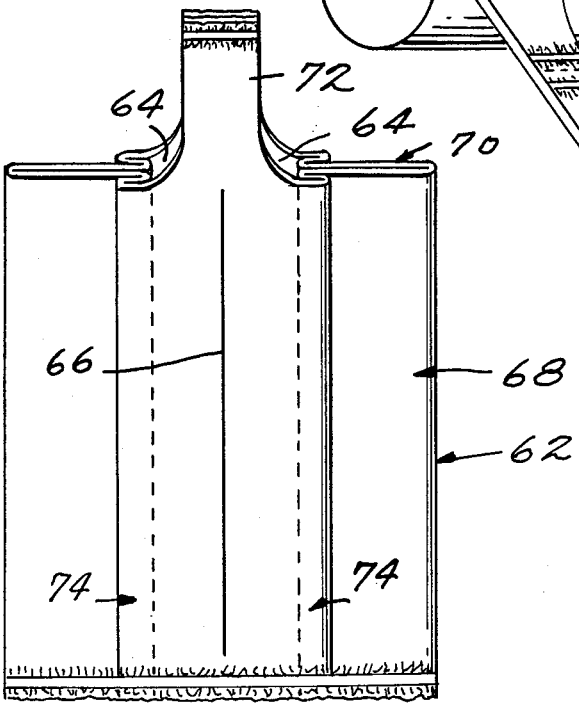
FIG. 8 is a perspective view of a bag with a central projecting handle and an internal partition, mouth-opening pleats being formed to each side of the partition.

FIG. 8, pursuant to the present invention, illustrates a plastic film bag 62 wherein the interior of the bag includes multiple compartments or chambers 64 defined by an interior partition 66, normally formed by a heat-sealing of the front and rear bag walls 68, 70 to each other. While the illustrated bag includes two chambers, one defined to each side of a central vertically extending handle 72, more than two chambers can be provided, preferably equally balanced to either side of the central handle for ease of carrying.

The individual chambers 64 open upwardly through chamber mouths defined along the upper edge of the bag outward of the handle 72 and between the upper edges of the overlying front and rear bag walls 68, 70. In accord with the present invention, each of the chambers has the front and rear walls comprising sections of the bag front and rear walls. The chamber walls are provided with full height mouth-opening pleats 74, defined as previously discussed and extending downward from the chamber mouth, preferably for the full height of the chamber. Provided in this manner, all of the chambers can be simultaneously opened following the procedures suggested in FIGS. 10 and 11. Alternatively, individual chambers can be opened utilizing the procedures of FIGS. 13 and 14.

The utilization of mouth-opening pleats in compartmented and partitioned bags as in FIGS. 7 and 8 is considered particularly significant in that the inherent difficulties of opening plastic film bags greatly increases as the effective width of the compartments or chambers decrease. Thus, while compartmented or partitioned film bags are both practical and highly desirable for a variety of reasons, some of which have been detailed in U.S. Pat. No. 4,696,403, their use has in turn given rise to problems, particularly with regard to obtaining access to the compartments or chambers. Accordingly, modification of the basic bags to incorporate the pleats of the present invention has made the use of such bags easy, efficient, and in every manner practical.

Figure 9:
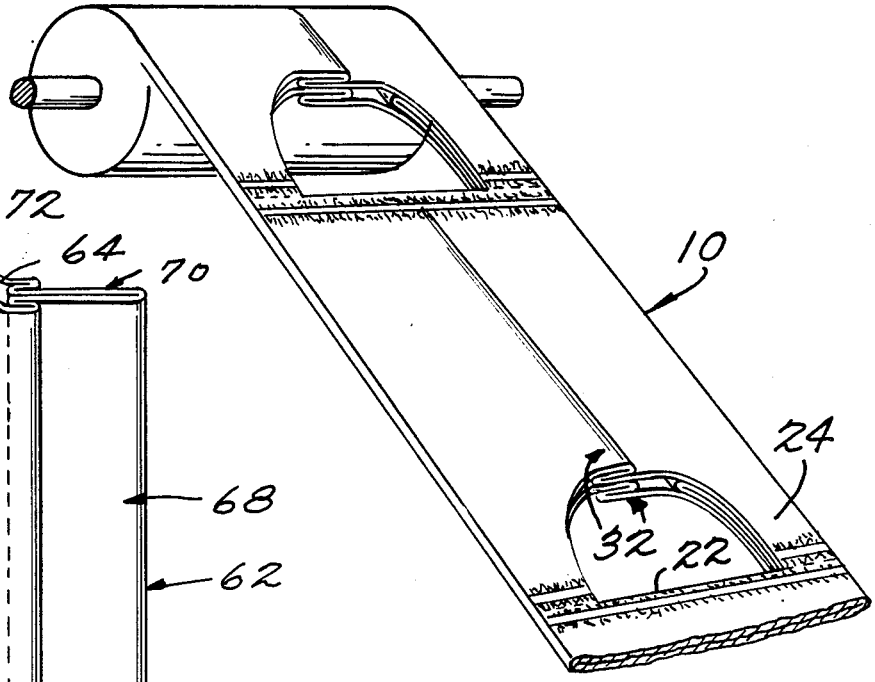
FIG. 9 illustrates a roll package of bags incorporating the mouth-opening pleats of the invention.

FIG. 9 schematically illustrates the formation of bags, in accord with any variation shown, as a continuous strip for packaging in a roll. The bags are subsequently dispensed from the roll with each leading bag severed from the immediately following bag in a known manner. Depending upon the nature of the bag and the manner in which the bag is grasped for severance from the roll, the expansion of the mouth-opening pleats can be effected either simultaneously with the removal of the bag or subsequent thereto. Noting FIG. 12, it is also to be appreciated that the bags can be provided in stacks.

The foregoing is considered illustrative of the principles of the invention. Other embodiments and variations as may occur to those skilled within the art are considered to fall within the scope of the invention.

WHAT IS CLAIMED IS:

1. A plastic film bag comprising overlying front and rear bag walls with joined side edges, said bag walls including overlying engaged upper edges defining a bag mouth transversely across said bag and terminating in opposed ends, said bag walls including sealed lower edges defining a closed bag bottom, and means integral with said bag for laterally separating the upper edges of said bag walls from each other and for initiating an opening of the bag mouth in response to an outward movement of the opposed ends of said bag mouth relative to each other.

2. The bag of claim 1 wherein said bag is a handle bag including handles integral with said bag walls and extending upward of said bag mouth at the opposed ends of said bag mouth whereby outward movement of said bag handles relative to each other will affect a corresponding outward movement of the opposed ends of the bag mouth, said means for laterally separating the upper edges and for initiating opening being defined in inwardly spaced relation between said handles.

3. The bag of claim 2 wherein said means for laterally separating the upper edges and for initiating opening comprises pleats in said bag walls extending downwardly from the bag mouth toward the sealed lower edges thereof, each said pleat being defined by overlying panels substantially free of each other and freely slidable relative to each other upon outward movement of the opposed ends of the bag mouth, the panels of each pleat including an intermediate panel which reverses upon outward movement of the opposed ends of the bag mouth and encourages lateral separation of the remaining panels of pleat and a corresponding separation of the front and rear bag walls.

4. The bag of claim 3 wherein each pleat extends the full height of the corresponding bag wall with the lower ends of the pleat panels sealed to the sealed lower edges of the bag walls for retention of the pleat panel lower ends, said pleats being fully openable in upwardly spaced relation to said bottom.

5. The bag of claim 4 including side gussets integrally joining the side edges of the bag walls.

6. The bag of claim 5 wherein a single pleat is formed in each bag wall centrally thereof.

7. The bag of claim 1 wherein said means for laterally separating the upper edges and for initiating opening comprises at least one pleat in one of said bag walls extending downwardly from the bag mouth toward the sealed lower edges thereof, each said pleat being defined by overlying panels substantially free of each other and freely slidable relative to each other upon outward movement of the opposed ends of the bag mouth, the panels of each pleat including an intermediate panel which reverses upon outward movement of the opposed ends of the bag mouth and encourages lateral separation of the remaining panels of the pleat and a corresponding separation of the front and rear bag walls.

8. The bag of claim 7 wherein each bag wall, in vertically spaced relation below the upper edge thereof, includes a hand-.accommodating hole defined therethrough, providing a handle means for said bag.

9. In a T-shirt bag of thermoplastic film material comprising front and rear bag walls with sealed lower edges and with laterally upwardly extending integral bag handles defining a transverse bag mouth between the lower ends of the handles: the improvement comprising means integral with said bag for automatically initiating opening of said bag mouth in response to lateral outward movement of said bag handles relative to each other.

10. The T-shirt bag of claim 9 wherein said means comprises pleats in said bag walls extending downwardly from the bag mouth toward the sealed lower edges thereof, each said pleat being defined by overlying panels substantially free of each other and freely slidable relative to each other upon outward movement of the bag handles, the panels of each pleat including an intermediate panel which reverses upon outward movement of the bag handles and encourages lateral separation of the remaining panels of the pleat and a corresponding separation of the front and rear bag walls.

11. The T-shirt bag of claim 10 wherein each pleat extends the full height of the corresponding bag wall with the lower ends of the pleat panels sealed to the sealed lower edges of the bag walls for retention of the pleat panel lower ends in overlying relation and precluding separation of the pleat panels at and immediately adjacent said lower ends, said pleats being unsecured and fully openable in upwardly spaced relation to said bottom.

12. The T-shirt bag of claim 11 including side gussets integrally joining the side edges of the bag walls.

13. A plastic film bag of the type commonly used by consumers for supporting produce, groceries, or the like, and having provision for permitting the consumer to readily overcome the natural tendency of the mouth of the bag to remain closed and to thereby facilitate the opening of the bag, said bag comprising:

front and rear flat walls of plastic film material, with said walls overlying each other and having joined side edges defining opposite sides of the bag, heat sealed straight bottom edges defining a closed bottom of the bag, and substantially non-joined upper edges defining an open mouth of the bag, and at least one pleat formed in at least one of said front and rear walls, with said at least one pleat extending continuously from said open mouth to said bottom of said bag, and comprising a folded portion of the associated wall so as to define overlying inner and outer panels, with said panels being otherwise substantially free of interconnection and lying substantially in the plane of the associated wall, whereby pivotal movement of the at least one pleat away from the plane of the associated wall tends to cause the lateral separation of the inner and outer panels of said pleat and a corresponding separation of the adjacent portions of the front and rear walls of said bag, to thereby overcome the natural tendency of the mouth to remain closed and thus facilitate the opening of the bag.

14. A plastic film bag comprising overlying front and rear bag walls with joined side edges, said bag walls including overlying engaged upper edges defining an open bag top transversely across said bag, said bag walls including sealed lower edges defining a closed bag bottom, vertical partition means defining transversely adjacent vertical compartments in said bag, each compartment being of a predetermined width and including front and rear compartment walls defined by overlying portions of said front and rear bag walls, each compartment including an upper compartment mouth defined by portions of said overlying upper edges coextensive with the compartment walls, and a vertical mouth-opening pleat in at least one compartment wall of each compartment, each pleat comprising transversely overlapping freely expandable panels extending from the compartment mouth toward the bag bottom.

15. The bag of claim 14 wherein the overlapping panels of each pleat are transversely slidable relative to each other for lateral separation of the mouth-defining upper edge portions of each compartment upon outward movement of the compartment wall to each side of the pleat, the panel of each pleat including an intermediate panel which reverses upon outward movement of the wall to each side thereof and encourages lateral separation of the remaining panels of the pleat and a corresponding separation of the front and rear compartment walls.

16. The bag of claim 15 wherein each pleat extends the full height of the corresponding compartment wall with the lower edges of the pleat panels sealed to the sealed lower edges of the bag wall for retention of the pleat panel lower edges, said pleats being fully openable in upwardly spaced relation to said bottom.

17. The bag of claim 16 wherein said bag is a handle bag including handles integral with said bag walls and extending upward of said open bag top outward of said compartment wall pleats to the opposite sides of said partition means whereby outward movement of the bag handles relative to each other will effect a corresponding mouth opening expansion of said pleats in each compartment.

18. The bag of claim 17 including a severance line longitudinally along said partition means for a selective severance of said bag between said compartments whereby separate carriers, each including a compartment, are defined.

19. The bag of claim 18 wherein a pleat is formed in both walls of each compartment centrally thereof.

20. The bag of claim 16 including a severance line longitudinally along said partition means for a selective severance of said bag between said compartments whereby separate carriers, each including a compartment, are defined.

21. The bag of claim 16 including a handle integrally defined with the upper edges of said bag walls centrally thereof, said handle projecting upwardly from said upper edges and defining a central carrying means for said bag, said partition means being vertically aligned below said handle with the defined compartments being laterally to opposed sides of the handle.

* * * * *